US006463899B2

(12) United States Patent
Tanaka et al.

(10) Patent No.: US 6,463,899 B2
(45) Date of Patent: Oct. 15, 2002

(54) VALVE OPERATING SYSTEM IN INTERNAL COMBUSTION ENGINE

(75) Inventors: Chikara Tanaka; Noriyuki Yamada; Hiromu Nakamura, all of Wako; Junichi Iwamoto, Tochigi, all of (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/745,991

(22) Filed: Dec. 26, 2000

(65) Prior Publication Data

US 2001/0015187 A1 Aug. 23, 2001

(30) Foreign Application Priority Data

Dec. 27, 1999 (JP) ..... 11-370831
Dec. 27, 1999 (JP) ..... 11-370836

(51) Int. Cl.[7] ..... F01L 1/18

(52) U.S. Cl. ..... 123/90.4; 123/90.36; 123/90.42; 123/90.44; 74/559

(58) Field of Search ..... 123/90.22, 90.36, 123/90.39, 90.4, 90.41, 90.42, 90.44, 90.45, 90.47; 74/519, 559; 29/888.2

(56) References Cited

U.S. PATENT DOCUMENTS

RE24,941 E * 2/1961 Latham ..... 123/90.36
4,515,116 A * 5/1985 Hayashi ..... 123/90.43
4,630,576 A * 12/1986 Raymond ..... 123/90.36
6,237,552 B1 * 5/2001 Hoag, Jr. ..... 123/90.22

FOREIGN PATENT DOCUMENTS

EP 0 887 519 A1 6/1998
JP 6-185322 7/1994

* cited by examiner

*Primary Examiner*—Weilun Lo
(74) *Attorney, Agent, or Firm*—Armstrong, Westerman & Hattori, LLP

(57) ABSTRACT

In a valve operating system in an internal combustion engine, a swinging support section provided at a base end of a rocker arm is swingably carried on a rocker shaft mounted in a cylinder head. A plurality of valve abutments are provided at a tip end of the rocker arm and capable of being individually put into abutment against upper ends of a plurality of engine valves, and a cam abutment is provided on the rocker arm in an intermediate portion between the swinging support section and each of the valve abutments to come into contact with a valve operating cam. The swinging support section comprises a thinner cylindrical portion surrounding the rocker shaft, and thicker cylindrical portions which are formed at a thickness larger than that of the thinner cylindrical portion into a cylindrical shape to surround the rocker shaft and which are integrally and continuously provided at axially opposite ends of the thinner cylindrical portion, respectively. Thus, it is possible to enhance the durability of the rocker arm, while avoiding an increase in weight of the rocker arm.

17 Claims, 12 Drawing Sheets

VALVE OPERATING SYSTEM IN INTERNAL COMBUSTION ENGINE

BACKGROUND OF THE INVENTION

1. Field of the Invention

The present invention relates to a valve operating system in an internal combustion engine, including a swinging support section provided at a base end of a rocker arm and swingably carried on a rocker shaft mounted in a cylinder head, a plurality of valve abutments provided at a tip end of the rocker arm and capable of being individually put into abutment against upper ends of a plurality of engine valves, and a cam abutment provided on the rocker arm in an intermediate portion between the swinging support section and each of the valve abutments to come into contact with a valve operating cam.

2. Description of the Related Art

Such a valve operating system is conventionally known, for example, from Japanese Patent Application Laid-open No. 6-185322.

In a valve operating system constructed such that a plurality of engine valves are driven by a single rocker arm, a difference in tappet clearance may be produced between the plurality of engine valves and a plurality of valve abutments provided on the rocker arm in individual correspondence to the engine valves due to the lapse of an operating time. If such a difference in tappet clearance is produced, a force causing the rocker arm to be inclined is applied to the rocker arm by a large load generated on a line interconnecting the cam abutment and one of the valve abutments at one end of an array of the valve abutments. For this reason, a large load is applied to opposite ends of the swinging support section in an axial direction of the rocker shaft, and if the swinging support section does not have a rigidity enough to withstand such load, there is a possibility that uneven wear may be produced in the swinging support section, resulting in a reduction in durability of the swinging support section. In the rocker arm of the above known valve operating system, however, the swinging support section is formed into a cylindrical shape at a wall thickness uniform over the entire length in the axial direction of the rocker shaft, and if the wall thickness of the swinging support section is increased in order to enhance the rigidity of the swinging support section, the weight of the rocker arm is increased.

SUMMARY OF THE INVENTION

Accordingly, it is an object of the present invention to provide a valve operating system in an internal combustion engine, wherein the durability of the rocker arm is enhanced, while avoiding an increase in weight of the rocker arm.

To achieve the above object, according to a first aspect and feature of the present invention, there is provided a valve operating system in an internal combustion engine, including a cylindrical swinging support section provided at a base end of a rocker arm and swingably carried on a rocker shaft mounted in a cylinder head, a plurality of valve abutments provided at a tip end of the rocker arm and capable of being individually put into abutment against upper ends of a plurality of engine valves, and a cam abutment provided on the rocker arm in an intermediate portion between the swinging support section and each of the valve abutments to come into contact with a valve operating cam, wherein the swinging support section includes a thinner cylindrical portion surrounding the rocker shaft, and thicker cylindrical portions which are form ed at a thickness larger than that of the thinner cylindrical portion into a cylindrical shape to surround the rocker shaft and which are integrally and continuously provided at axially opposite ends of the thinner cylindrical portion, respectively.

With such arrangement of the first feature, a central portion of the swinging support section can be formed at a smaller thickness, thereby avoiding an increase in weight of the rocker arm, while the opposite end portions of the swinging support section, to which a large load may be possibly applied, can be formed at a larger thickness, thereby enhancing the rigidity of supporting of the rocker arm to enhance the durability of th e rocker arm.

According to a second aspect and feature of the present invention, in addition to the first feature, the swinging support section has grooves defined in its inner surface at opposite ends thereof along the axis of the rocker shaft and capable of accumulating an oil between the opposite ends and an outer surface of the rocker shaft, respectively.

With such arrangement of the second feature, the oil can be accumulated between the opposite ends of the swinging support section and the rocker shaft, and even if the rocker arm is inclined, the generation of uneven wear can be prevented to the utmost, thereby enhancing the durability of the rocker arm. Moreover, the grooves are merely provided in the inner surface of the swinging support section at its opposite ends and hence, the weight of the rocker arm cannot be increased.

According to a third aspect and feature of the present invention, in addition to the second feature, first one of the valve abutments arranged in parallel to the axis of the rocker shaft, which is disposed on one side along the axis of the rocker shaft, is provided at a tip end of a first support wall provided to extend from one end of the swinging support section at a location corresponding to one of the grooves, and second one of the valve abutments, which is disposed on the other side along the axis of the rocker shaft, is provided at a tip end of a second support wall provided to extend from the other end of the swinging support section at a location corresponding to the other groove.

With such arrangement of the third feature, a reduction in rigidity of the opposite ends of the swinging support section due to the provision of the grooves can be made up for by the support walls.

According to a fourth aspect and feature of the present invention, in addition to the first feature, the swinging support section includes a thinner cylindrical portion surrounding the rocker shaft, and thicker cylindrical portions which are formed at a thickness larger than that of the thinner cylindrical portion into a cylindrical shape to surround the rocker shaft and which are integrally and continuously provided at axially opposite ends of the thinner cylindrical portion, the thicker cylindrical portions having grooves provided in their inner surfaces respectively and capable of accumulating an oil between the inner surfaces and an outer surface of the rocker shaft.

With such arrangement of the fourth feature, a central portion of the swinging support section can be formed at a smaller thickness, thereby avoiding an increase in weight of the rocker arm, while the opposite end portions of the swinging support section, to which a large load may be possibly applied, can be formed at a larger thickness, thereby enhancing the rigidity of supporting of the rocker arm. Further, the oil can be accumulated between the opposite ends of the swinging support section and the rocker shaft and hence, the generation of uneven wear can be prevented to the utmost. Moreover, since the grooves are provided in the inner surface of the thicker cylindrical portion, it is possible to avoid a reduction in rigidity of the swinging support section due to the provision of the grooves and to reliably enhance the durability.

According to a fifth aspect and feature of the present invention, in addition to the first feature, a pair of intersection points, at which the following straight lines and the axis of the rocker shaft intersect one another, are disposed at locations inner than the axially opposite ends of the swinging support section: a first straight line passing through (1) a center of first one of the valve abutments arranged in parallel to the axis of the rocker shaft, which is disposed at one end along the axis of the rocker shaft, and (2) an area of contact of the valve operating cam with the cam abutment; and a second straight line passing through (1) a center of second one of the valve abutments, which is disposed at the other end along the axis of the rocker shaft and (2) the area of contact of the valve operating cam with the cam abutment.

With such arrangement of the fifth feature, a difference in tappet clearance is produced between the first and second ones of the valve abutments arranged in parallel to the axis of the rocker shaft, which are disposed at the one end and the other end along the axis of the rocker shaft. Even if a large load is generated on the first or second straight lines and acts to incline the rocker arm, the rocker arm can be supported stably and prevented from being inclined, because, the swinging support section is supported on the rocker shaft on the first and second straight lines. Therefore, it is possible to prevent the generation of uneven wear in the swinging support section and the cam abutment.

According to a sixth aspect and feature of the present invention, in addition to the fifth feature, the swinging support section is formed at a length larger than a distance between the first and second abutments, and straight lines passing through centers of the first and second valve abutments and perpendicular to the axis of the rocker shaft are disposed at locations inner than the axially opposite ends of the swinging support section. With such arrangement of the sixth feature, the swinging support section is supported on the rocker shaft over a length larger than the distance between the valve abutments at the one end and the other end along the axis of the rocker shaft, and the rocker shaft can be supported more stably.

According to a seventh aspect and feature of the present invention, in addition to the first feature, the swinging support section has a rib projectingly provided on an outer surface thereof to extend in a direction intersecting a plane perpendicular to the axis of the rocker shaft. With such arrangement of the seventh feature, the rib is projectingly provided on the outer surface of the swinging support section to extend in the direction intersecting the plane perpendicular to the axis of the rocker shaft. Therefore, as compared with a system in which the entire swinging support section is formed at a larger thickness, it is possible to avoid, to the utmost, that the layout of the rocker arm is limited, and to enhance the rigidity of the swinging support section, while suppressing an increase in weight of the rocker arm to the minimum.

According to an eighth aspect and feature of the present invention, in addition to the seventh feature, the rib is provided on an outer surface of the thinner cylindrical portion to connect the thicker cylindrical portions to each other. With such arrangement of the eighth feature, it is possible to further enhance the rigidity of the swinging support section to provide an increase in durability by interconnecting the thicker cylindrical portions at the opposite ends of the swinging support section, to which a large load may be possibly applied.

According to a ninth aspect and feature of the present invention, in addition to the seventh or eighth feature, the rib is formed to protrude from the swinging support section in a direction intersecting a plane perpendicular to a direction of application of a load from the valve operating cam to the rocker arm. With such arrangement of the ninth feature, it is possible to sufficiently enhance the rigidity of the swinging support section against a strike load from the valve operating cam.

According to a tenth aspect and feature of the present invention, in addition to the seventh or eighth feature, a pair of the ribs are provided on the outer surface of the swinging support section at locations symmetric with the axis of the rocker shaft. With such arrangement of the tenth feature, it is possible to enhance the rigidity of the swinging support section by an extremely small number of the ribs and to suppress an increase in weight of the swinging support section and thus the rocker arm to the minimum.

According to an eleventh aspect and feature of the present invention, in addition to the seventh or eighth feature, the cylinder head having the rocker shaft mounted therein has a mounting member mounted therein and disposed sideways of the swinging support section, and the swinging support section has a notch provided therein at a location corresponding to the mounting member and recessed on a side opposite to the mounting member. With such arrangement of the eleventh feature, the rocker arm can be disposed in proximity to the mounting member, while maintaining a rigidity increasing effect provided by the rib, and the limitation of the layout of the rocker arm can be further moderated. In addition, the weight of the rocker arm can be reduced by the provision of the notch and moreover, a reduction in rigidity due to the provision of the notch can be inhibited by the rib.

According to a twelfth aspect and feature of the present invention, there is provided a valve operating system in an internal combustion engine, comprising a cylindrical swinging support section provided at a base end of a rocker arm and swingably carried on a rocker shaft mounted in a cylinder head, a plurality of valve abutments provided at a tip end of the rocker arm and capable of being individually put into abutment against upper ends of a plurality of engine valves, and a cam abutment provided on the rocker arm in an intermediate portion between the swinging support section and each of the valve abutments to come into contact with a valve operating cam, wherein the swinging support section has grooves provided in its inner surface at opposite ends thereof along the axis of the rocker shaft and capable of accumulating an oil between the opposite ends and an outer surface of the rocker shaft.

With such arrangement of the twelfth feature, the oil can be accumulated between the opposite ends of the swinging support section and the rocker shaft, and even if the rocker arm is inclined, uneven wear can be prevented to the utmost from being produced in the rocker arm. Moreover, the grooves are merely provided in the inner surface of the swinging support section at the opposite ends thereof and hence, the weight of the rocker arm cannot be increased.

According to a thirteenth aspect and feature of the present invention, there is provided a valve operating system in an internal combustion engine, comprising a cylindrical swinging support section provided at a base end of a rocker arm and swingably carried on a rocker shaft mounted in a cylinder head, a plurality of valve abutments provided at a tip end of the rocker arm and capable of being individually put into abutment against upper ends of a plurality of engine valves, and a cam abutment provided on the rocker arm in an intermediate portion between the swinging support section and each of the valve abutments to come into contact with a valve operating cam, wherein the swinging support section comprises a thinner cylindrical portion surrounding the rocker shaft, and thicker cylindrical portions which are formed at a thickness larger than that of the thinner cylindrical portion into a cylindrical shape to surround the rocker shaft and which are integrally and continuously provided at axially opposite ends of the thinner cylindrical portion, respectively, the thicker cylindrical portions having grooves provided in their inner surfaces, respectively, and capable of accumulating an oil between the opposite ends and an outer surface of the rocker shaft.

With such arrangement of the thirteenth feature, a central portion of the swinging support section can be formed at a smaller thickness, thereby avoiding an increase in weight of the rocker arm, while the opposite end portions of the swinging support section, to which a large load may be possibly applied, can be formed at a larger thickness, thereby enhancing the rigidity of supporting of the rocker arm. The oil can be accumulated between the opposite ends of the swinging support section and the rocker shaft, and even if the rocker arm is inclined, uneven wear can be prevented to the utmost from being produced in the rocker arm. Moreover, the grooves are provided in the inner surfaces of the thicker cylindrical portions and hence, it is possible to avoid a reduction in rigidity of the swinging support section due to the groove and to reliably enhance the durability of the swinging support section.

The above and other objects, features and advantages of the invention will become apparent from the following description of the preferred embodiments taken in conjunction with the accompanying drawings.

BRIEF DESCRIPTION OF THE DRAWINGS

FIG. 1 is a partially vertical sectional view of an internal combustion engine;

FIG. 2 is a plan view taken in a direction of an arrow 2 in FIG. 1;

FIG. 3 is a plan view of an exhaust-side rocker arm;

FIG. 4 is a sectional view taken along a line 4—4 in FIG. 2;

FIG. 5 is a sectional view taken along a line 5—5 in FIG. 2;

FIG. 6 is a sectional view taken along a line 6—6 in FIG. 5;

FIG. 7 is a sectional view taken along a line 7—7 in FIG. 6;

FIGS. 9 to 12 show a third embodiment of the present invention, wherein

FIG. 9 is a plan view of a portion of an internal combustion engine, similar to FIG. 12;

FIG. 10 is a plan view of an exhaust-side rocker arm;

FIG. 11 is a sectional view taken along a line 11—11 in FIG. 9; and

FIG. 12 is a vertical sectional view of a casting apparatus in an area corresponding to a line 11—11 in FIG. 9.

DESCRIPTION OF THE PREFERRED EMBODIMENTS

Figure 1:
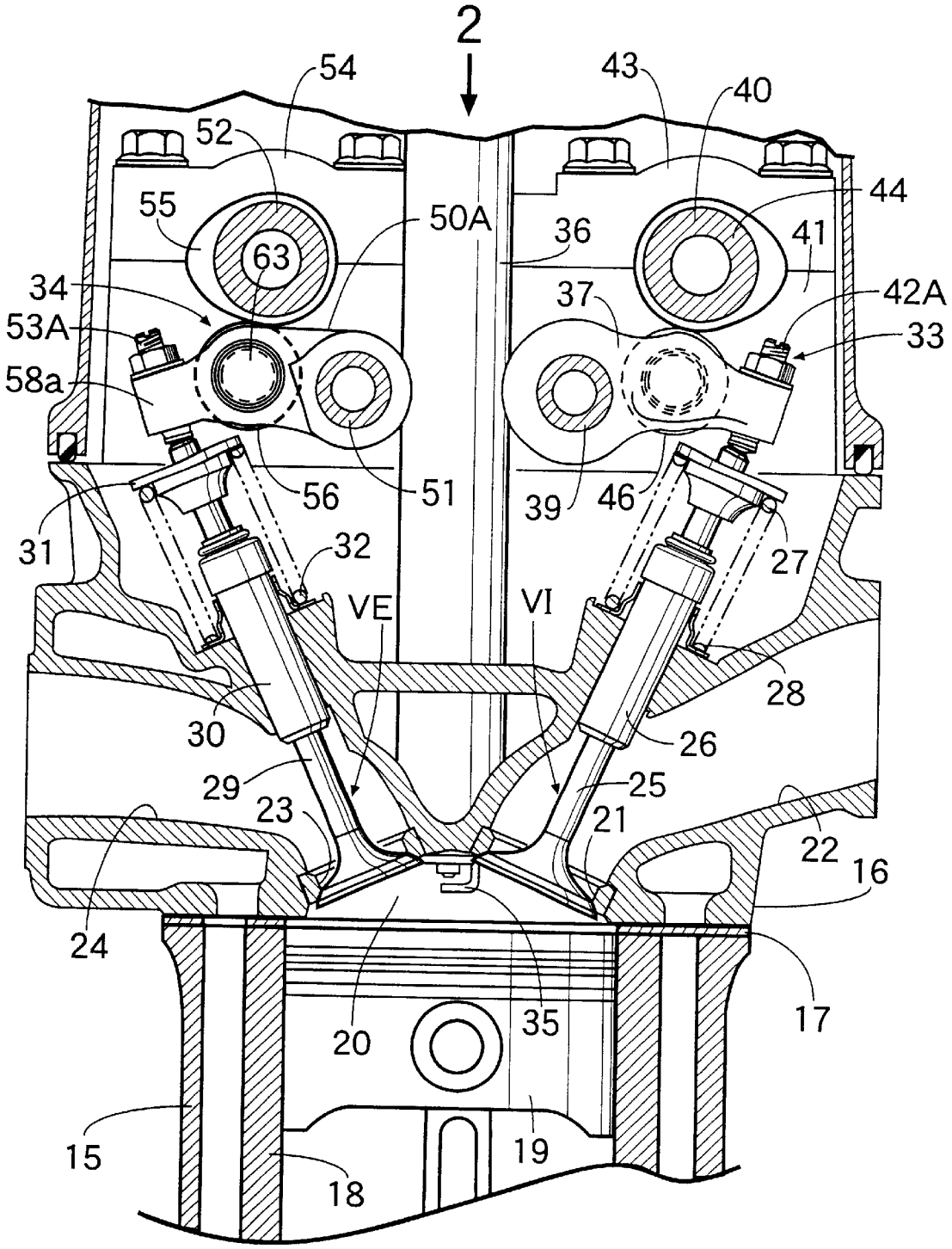
FIGS. 1 to 7 show a first embodiment of the present invention.
Figure 2:
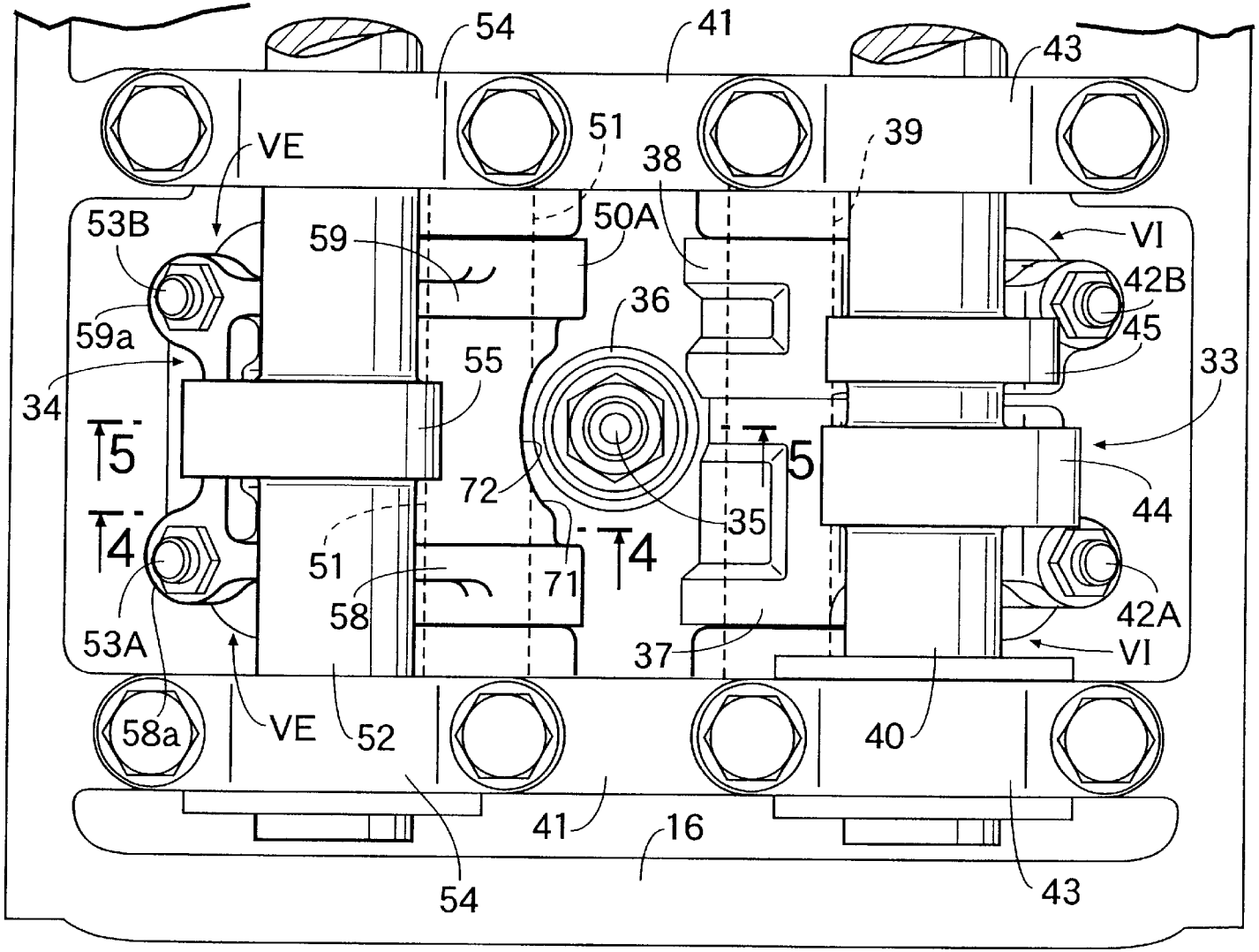

A first embodiment of the present invention will be described with reference to FIGS. 1 to 7. Referring first to FIGS. 1 and 2, a multi-cylinder internal combustion engine includes a cylinder block 15, and a cylinder head 16 coupled to an upper portion of the cylinder block 15 through a gasket 17. A piston 19 is slidably received in each of cylinders 18 provided in the cylinder block 15. A combustion chamber 20 is defined in each of the cylinders by the cylinder block 15, the cylinder head 16 and each of the pistons 19.

Provided in the cylinder head 16 for every cylinder are a pair of intake valve bores 21 facing one side of a ceiling surface of the combustion chamber 20, an intake port 22 which opens into one side (a right side in FIG. 1) of the cylinder head 16 and connected commonly to the intake valve bores 21, a pair of exhaust valve bores 23 facing the other side of the ceiling surface of the combustion chamber 20, and an exhaust port 24 which opens into the other side (a left side in FIG. 1) of the cylinder head 16.

Stems 25 of intake valves VI, VI capable of opening and closing the intake valve bores 21 are slidably received in guide tubes 26 mounted in the cylinder head 16, and valve springs 28 for biasing the intake valves VI, VI upwards, i.e., in valve closing directions are mounted between the cylinder head 16 and retainers 27, 27 mounted at upper ends of the stems 25 protruding upwards from the guide tubes 26. Stems 29 of exhaust valves VE, VE as engine valves capable of opening and closing the exhaust valve bores 23 are slidably received in guide tubes 30 mounted in the cylinder head 16, and valve springs 32 for biasing the exhaust valves VE, VE upwards, i.e., in valve closing directions are mounted between the cylinder head 16 and retainers 31, 31 mounted at upper ends of the stems 29 protruding upwards from the guide tubes 30.

The intake valves VI, VI are opened and closed by an intake-side valve operating device 33, and the exhaust valves VE, VE are opened and closed by an exhaust-side valve operating device 34. A plug insertion tube 36 is disposed to extend vertically, so that a spark plug 35 mounted in the cylinder head 16 to face a central portion of the combustion chamber 20 is inserted into the plug insertion tube 36 as a mounting member. The plug insertion tube 36 is attached at its lower end to the cylinder head 16.

The intake-side valve operating device 33 includes a pair of intake-side rocker arms 37 and 38 individually corresponding to the pair of intake valves VI, VI, an intake-side rocker shaft 39 on which the intake-side rocker arms 37 and 38 are swingably carried, and an intake-side camshaft 40 which is rotatable about an axis parallel to the rocker shaft 39.

The intake-side rocker shaft 39 is fixedly supported by holder walls 41 provided on the cylinder head 16 between the cylinders, and intake-side rocker arms 37 and 38 are swingably carried at their base ends on the intake-side rocker shaft 39. Tappet screws 42A and 42B are threadedly fitted at tip ends of the intake-side rocker arms 37 and 38 to abut against upper ends of the corresponding intake valves VI, VI, i.e., upper ends of the stems 25, so that their advanced and retracted positions can be adjusted. The intake-side camshaft 40 is operatively connected at a reduction ratio of ½ to a crankshaft (not shown) and rotatably carried by the holder walls 41 and cam holders 43 fastened to upper ends of the holder walls 41.

The intake-side camshaft 40 is provided with a high-speed valve operating cam 44 corresponding to one of the intake-side rocker arms 37, and a low-speed valve operating cam 45 corresponding to the other intake-side rocker arm 38. A roller 46 supported on the one intake-side rocker arm 37 is in rolling contact with the high-speed valve operating cam 44, and a roller (not shown) supported on the other intake-side rocker arm 38 is in rolling contact with the low-speed valve operating cam 45.

Moreover, an interlocking-motion switchover means (not shown) is provided between the intake-side rocker arms 37 and 38 and capable of switching over the interlocking motion of the rocker arms 37 and 38 and the releasing of the interlocking motion one from another, so that the rocker arms 37 and 38 are swung independently from each other during operation of the engine at a low speed and the rocker arms 37 and 38 are swung operatively from each other in an interlocking motion during operation of the engine at a high speed. Therefore, during operation of the engine at the low speed, the one intake-side rocker arm 37 is swung to open and close one of the intake valves VI in an operational characteristic corresponding to a cam profile of the high-speed valve operating cam 44, while the other intake-side rocker arm 38 is swung to open and close the other intake valves VI in an operational characteristic corresponding to a cam profile of the low-speed valve operating cam 45. During operation of the engine at the high speed, both of the intake-side rocker arms 37 and 38 are swung to open and close the intake valves VI, VI in the operational characteristic corresponding to the high-speed valve operating cam 44.

The exhaust-side valve operating device 34 includes a single exhaust-side rocker arm 50A which is common to the pair of exhaust valves VE and VE, an exhaust-side rocker shaft 51 serving as an arm support portion on which the exhaust-side rocker arm 50A is swingably carried and an exhaust-side cam shaft 52 which is rotatable about an axis parallel to the rocker shaft 51.

The exhaust-side rocker shaft 51 has an axis parallel to the intake-side rocker shaft 39 and is fixedly supported by the holder wall 41, as is the intake-side rocker shaft 39. The exhaust-side rocker arm 50A is swingably carried at its base end on the exhaust-side rocker shaft 51, and first and second tappet screws 53A and 53B as valve abutments are threadedly fitted at tip ends of the exhaust-side rocker arm 50A to abut against upper ends of the corresponding exhaust valves VE, VE, i.e., upper ends of the stems 29, so that their advanced and retracted positions can be adjusted. The exhaust-side camshaft 52 is operatively connected at a reduction ratio of ½ to the crankshaft (not shown) rotatably carried by the holder walls 41 and cam holders 54 fastened to the upper ends of the holder walls 41.

A valve operating cam 55 is provided on the exhaust-side camshaft 52 in correspondence to the exhaust-side rocker arm 50A, and a roller 56 as a cam abutment axially supported on the exhaust-side rocker arm 50A is in rolling contact with the valve operating cam 55.

Figure 3:
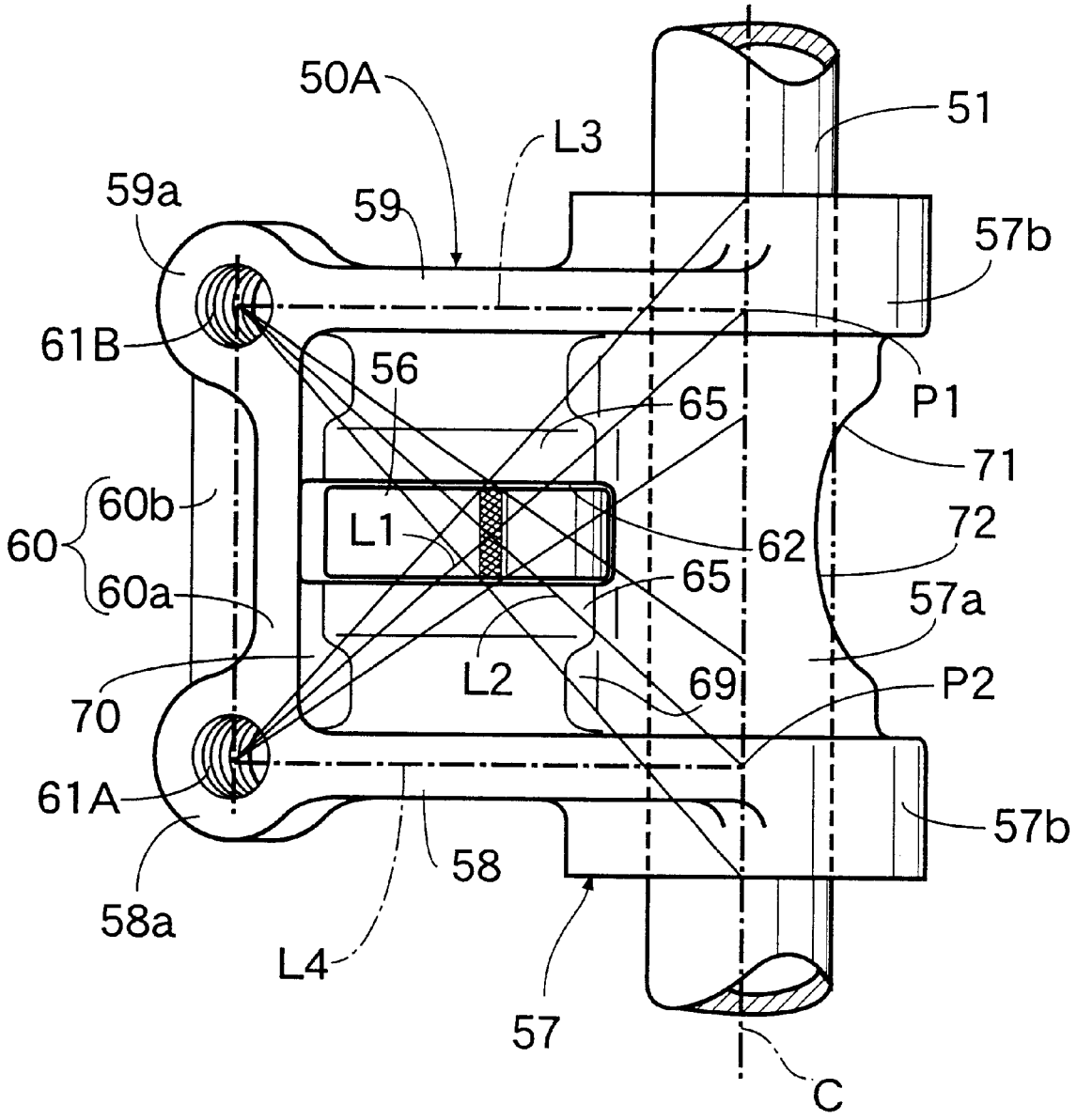

Referring to FIG. 3, the exhaust-side rocker arm 50A is provided at its base end with a cylindrical swinging support section 57 through which the exhaust-side rocker shaft 51 is inserted and which is swingably carried on the rocker shaft 51. The exhaust-side rocker arm 50A is further provided with first and second support walls 58 and 59, and a connection wall 60 connecting tip ends of the first and second support walls 58 and 59 to each other.

First and second boss portions 58*a* and 59*a* each having a circular outer peripheral surface are integrally formed on respective tip ends of the first and second support walls 58 and 59, so that they are arranged parallel to the axis of the exhaust-side rocker shaft 51. It is preferable that the first and second support walls 58 and 59 are provided to extend from opposite ends of the swinging support section 57 along a plane perpendicular to the axis of the exhaust-side rocker shaft 51, and that the first and second boss portions 58*a* and 59*a* and the swinging support section 57 are interconnected by the first and second support walls 58 and 59 perpendicular to the axis of the exhaust-side rocker shaft 51.

The boss portions 58*a* and 59*a* are provided with threaded bores 61A and 61B into which the first and second tappet screws 53A and 53B are threadedly engaged. The roller 56 is supported on the exhaust-side rocker arm 50A in a location intermediate between the swinging support section 57 and the tappet screws 53A and 53B, i.e., at a location displaced from the axis of the exhaust-side rocker shaft 51.

A first straight line L1 extends through (1) the center of one 53A of the first and second tappet screws 53A and 53B which is disposed on axially one side (a lower end side in FIG. 3) of the exhaust-side rocker shaft 51, i.e., the center of the threaded bore 61A in the first boss portion 58*a*, and (2) an area of contact (an area indicated by intersecting oblique lines in FIG. 3) of the valve operating cam 55 with the roller 56. A second straight line L2 extends through (1) the center of the other 53B of the first and second tappet screws 53A and 53B which is disposed on the axially other side (an upper end side in FIG. 3) of the exhaust-side rocker shaft 51, i.e., the center of the threaded bore 61B in the second boss portion 59*a*, and (2) an area of contact of the valve operating cam 55 with the roller 56. The first and second straight lines L1 and L2 and the axis C of the exhaust-side rocker shaft 51 intersect together at intersection points P1 and P2 as viewed in the plane of the exhaust-side rocker arm 50A. The intersection points P1 and P2 are disposed at locations inside axially opposite sides of the swinging support section 57. In other words, the swinging support section 57 is formed to have such a length that their opposite ends faces are disposed outside the first and second intersection points P1 and P2. It is desirable that the first and second straight lines L1 and L2 pass through the center of the area of contact of the valve operating cam 55 with the roller 56.

Moreover, the swinging support section 57 is formed at a length longer than a distance between the centers of the first and second tappet screws 53A and 53B, and third and fourth straight lines L3 and L4 passing through the centers of the first and second tappet screws 53A and 53B and intersecting the axis C of the exhaust-side rocker shaft 51 at right angles are. disposed inside the axially opposite ends of the swinging support section 57.

Figure 4:
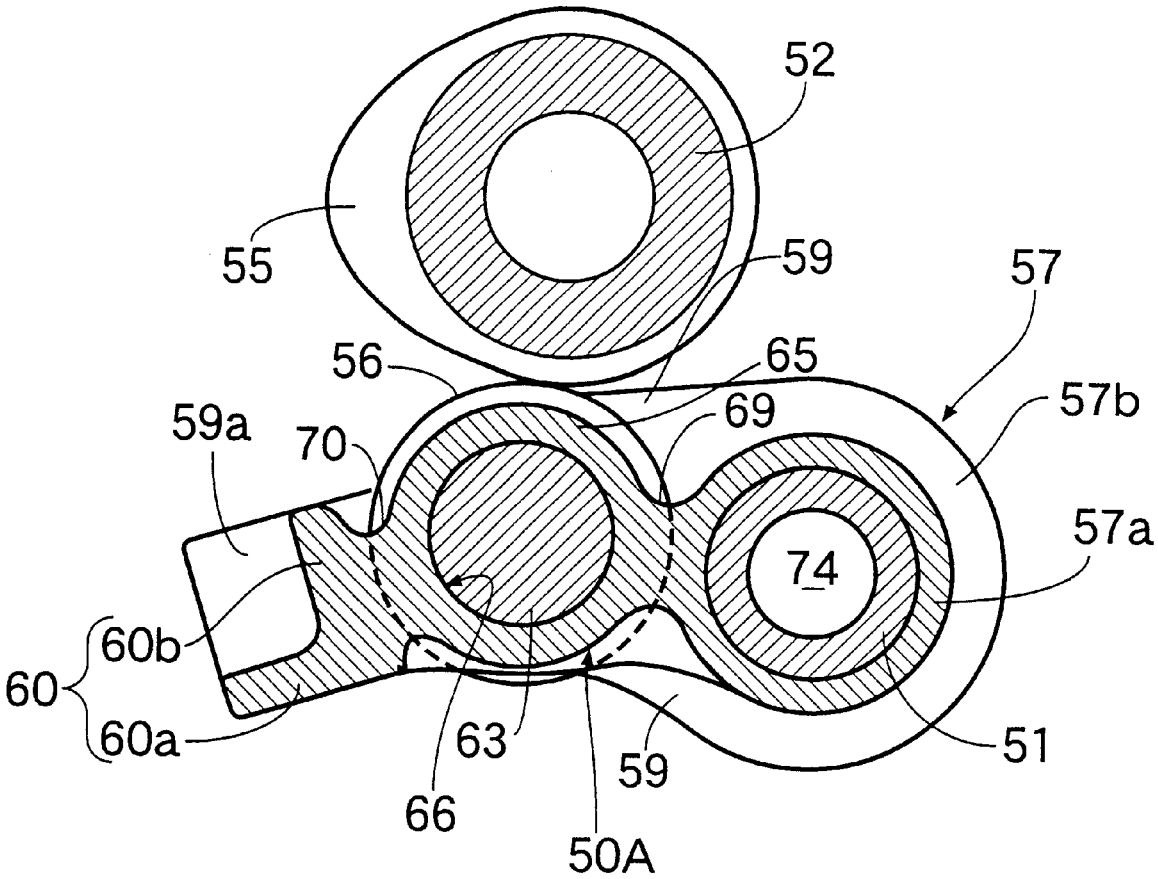
Figure 5:
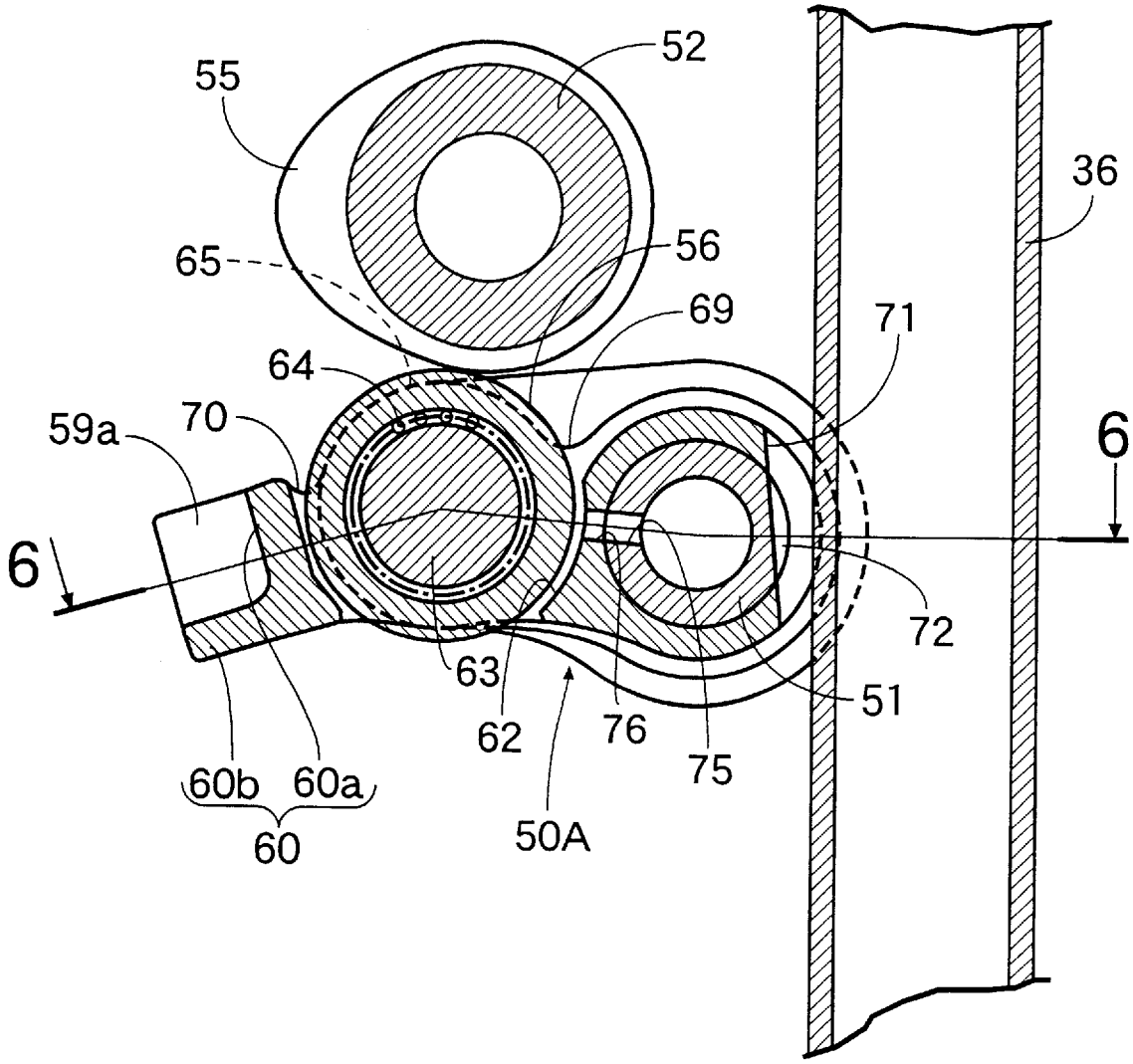
Figure 6:
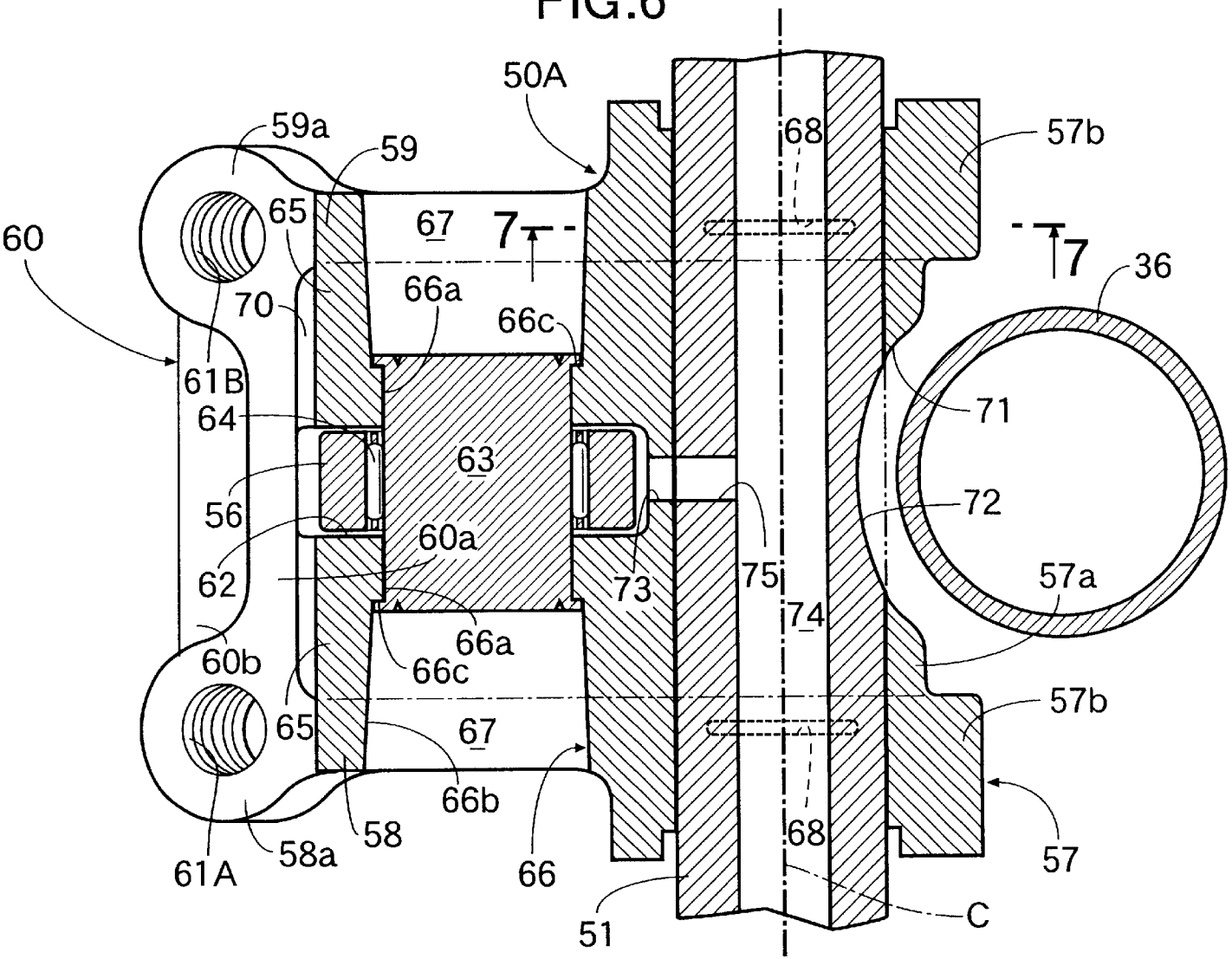

Referring also to FIGS. 4 to 6, a rectangular opening 62 for accommodation of the roller 56 is provided in the exhaust-side rocker arm 50A between the first and second support walls 58 and 59. A roller shaft 63, which has a length shorter than a distance between the first and second support walls 58 and 59 and has an axis parallel to the exhaust-side rocker shaft 51, extends across the opening 62 and is fixed to the exhaust rocker arm 50A, and the roller 56 is rotatably carried on the roller shaft 63 with a needle bearing 64 interposed therebetween.

A pair of shaft support portions 65, 65 which are formed into a cylindrical shape are provided over the first and second support walls 58 and 59 and the opening 62 respectively to extend in parallel to the exhaust-side rocker shaft 51. Shaft insertion bores 66, 66 are coaxially provided in the shaft support portions 65, 65, respectively, with its inner end opening into the opening 62 and with its outer end opening outwards and sideways of the exhaust-side rocker arm 50A, i.e., outwards and sideways of the first and second support walls 58, 59.

The shaft insertion bore 66 comprises a first insertion bore portion 66*a* adjacent the opening 62, a second insertion bore portion 66*b* connected at its inner end to an outer end of the first insertion. bore portion 66*a*, and a step 66*c* formed between the outer end of the first insertion bore portion 66*a* and the inner end of the second insertion bore portion 66*b* and facing on a side opposite from the opening 62. It is desirable that the first and second insertion bore portions 66*a* and 66*b* are formed as coaxial circular bores, so that the annular step 66*c* is formed between both of the insertion bore portions 66*a* and 66*b*. If the first and second insertion bore portions 66*a*and 66*b* are formed as described above, it is easy to carry out a boring for forming them. Alternatively, the first insertion bore portion 66*a* may be circular in cross section, while the second insertion bore portion 66*b* may be non-circular in cross section. Namely, the second insertion bore portion 66*b* may be of any cross-sectional shape, if the step 66*c* is formed between the first and second insertion bore portions 66*a* and 66*b* to face on the side opposite from the opening 62.

The roller shaft 63 is fitted in and fixed to inner ends of the shaft insertion bores 66, 66 with each of portions of the shaft insertion bores 66 axially outer than opposite ends of the roller shaft 63 being left in a hollow form. For such fitting and fixing, outer peripheral edges of the opposite ends of the roller shaft 63 fitted in the first insertion bore portions 66*a*, 66*a* are brought into caulked engagement with the steps 66*c*, 66*c*. Thus, wall-removed portions 67, 67 are formed in the exhaust-side rocker arm 50A at locations axially outside the opposite ends of the roller shaft 63 in a state in which the roller shaft 63 has been fixed to the exhaust-side rocker arm 50A.

The cylindrical swinging support section 57 comprises a thinner cylindrical portion 57*a* surrounding the exhaust-side rocker shaft 51, and thicker cylindrical portions 57*b*, 57*b* thicker than the thinner cylindrical portion 57*a* and continuously and integrally formed at opposite ends of the thinner cylindrical portion 57*a*, respectively. The first and second support walls 58 and 59 are formed continuously with the thicker cylindrical portions 57*b*, 57*b*.

Figure 7:
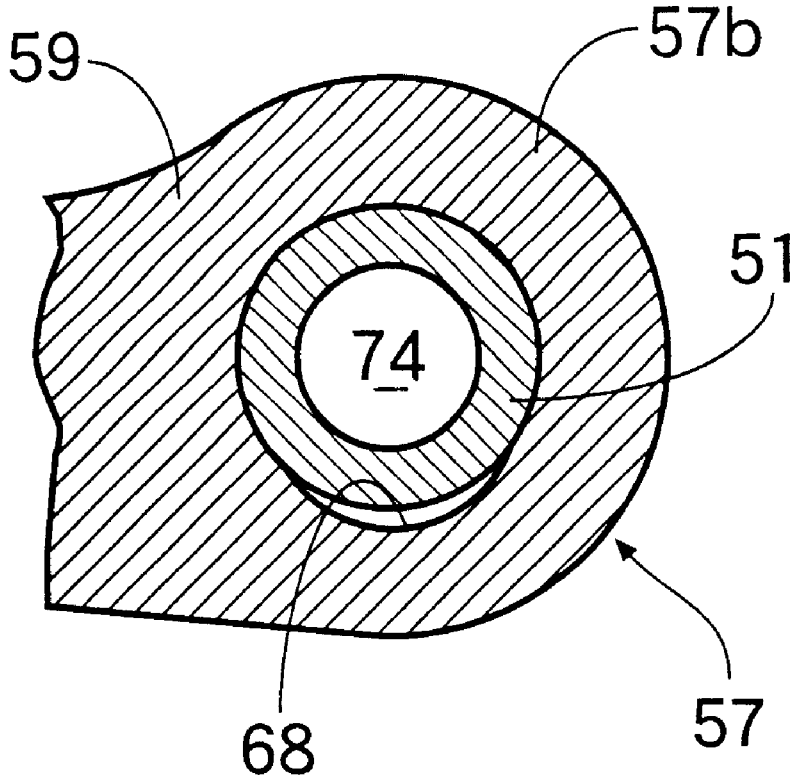

Referring also to FIG. 7, grooves 68, 68 capable of accumulation of an oil between the grooves and the outer surface of the exhaust-side rocker shaft 51 are provided in an arcuate shape in lower portions of inner surfaces of the thicker cylindrical portions 57*b*, 57*b* corresponding to connections of the first and second support walls 58 and 59, respectively.

Recesses 69 and 70 capable of supplying the oil to the roller 56 within the opening 62 are defined in portions of the upper surface of the exhaust-side rocker arm 50A, which are surrounded by the first and second support walls 58 and 59, the connection wall 60 and the swinging support section 57.

One of the recesses 69 is defined in the exhaust-side rocker arm 50A between the shaft support portions 65, 65 and the swinging support section 57, and the other recess 70 is defined in the exhaust-side rocker arm 50A between the shaft support portions 65, 65 and the connection wall 60.

An axially central portion of the swinging support section 57, i.e., an axially intermediate portion of the thinner cylindrical portion 57*a* is disposed at a location corresponding to the plug insertion tube 36. Notches 71 and 72 connected to each other are provided in the swinging support section 57 and the exhaust-side rocker shaft 51 at the location corresponding to the plug insertion tube 36 and formed into such an arcuate shape that they are recessed on a side opposite to the plug insertion tube 36, and a portion of the plug insertion tube 36 is accommodated in the notch 71. Moreover, the notches 71 and 72 are provided in the swinging support section 57 and the exhaust-side rocker shaft 51 between connections of the first and second support walls 58 and 59 to the swinging support section 57.

An oil injection bore 73 is provided, with its outer end opening into the opening 62, in the swinging support section 57 on a side opposite to the notch 71 with respect to the axis C of the exhaust-side rocker shaft 51. An oil supply passage 74 is provided in the exhaust-side rocker shaft 51 to extend along the axis C of the exhaust-side rocker shaft 51, and an oil supply bore 75 is also provided in the exhaust-side rocker shaft 51 to communicate with the oil supply passage 74, and is capable of communicating at its outer end with an inner end of the oil injection bore 73. The oil supply passage 74 is connected to an oil supply source which is not shown. Therefore, it is possible to supply the oil through the oil supply passage 74 within the exhaust-side rocker shaft 51 via the oil supply bore 75 and the oil injection bore 73 to the roller 56 to lubricate the roller 56. The communication between the oil supply bore 75 and the oil injection bore 73 may be cut off depending on a swung state of the exhaust-side rocker arm 50A, but in the cut-off state, the oil supplied from the oil supply bore 75 is used for the lubrication between the swinging support section 57 and the exhaust-side rocker shaft 51, and the oil is also supplied to the grooves 68, 68 in the inner surface of the swinging support section 57.

The connection wall 60 interconnecting the tip ends of the first and second support walls 58 and 59, i.e., the first and second boss portions 58*a* and 59*a* comprises first and second wall portions 60*a* and 60*b* intersecting each other at right angles in a plane perpendicular to the axis C of the exhaust-side rocker shaft 51, i.e., the swinging axis of the exhaust-side rocker arm 50A. The wall portions 60*a* and 60*b* intersect each other to form, for example, a substantially L-shape in such plane.

Moreover, the second wall portion 60*b* is formed to extend in parallel to the axis of the exhaust-side rocker shaft 51 with its outer surface connected flush to outer surfaces of the first and second boss portions 58*a* and 59*a* at their tip ends. One side of the opening 62 is defined by a portion of an inner surface of the first wall portion 60*a*.

The operation of the first embodiment will be described below. In the exhaust-side rocker arm 50A, the intersection points P1 and P2, at which (a) the first straight line LI extending through (1) the center of one 53A of the first and second tappet screws 53A and 53B arranged in parallel to the axis C of the exhaust-side rocker shaft 51, which is disposed on the axially one side of the exhaust-side rocker shaft 51 and (2) the area of contact of the valve operating cam 55 with the roller 56, preferably the center of such area, (b) the second straight line L2 extending through (1) the center of the other 53B of the first and second tappet screws 53A and 53B which is disposed on the axially other side (an upper end side in FIG. 3) of the exhaust-side rocker shaft 51 and (2) the area of contact of the valve operating cam 55 with the roller 56, preferably the center of such area, and (c) the axis C of the exhaust-side rocker shaft 51 intersect together as viewed in the plane of the exhaust-side rocker arm 50A, are disposed inside the axially opposite ends of the cylindrical swinging support section 57 swingably carried on the exhaust-side rocker shaft 51.

Therefore, even if a difference is produced between the tappet clearances in the first and second tappet screws 53A and 53B, and a large load is produced on the first or second straight line L1, L2 to act so as to incline the exhaust-side rocker arm 50A, the exhaust-side rocker arm 50A can be supported stably, because the swinging support section 57 is supported on the exhaust-side rocker shaft 51 on the first and second straight lines L1 and L2. As a result, it is also possible to prevent an uneven wear from being produced in the swinging support section 57 and the roller 56.

In addition, the swinging support section 57 is formed at the length longer than the distance between the centers of the first and second tappet screws 53A and 53B, and the third and fourth straight lines L3 and L4 passing the centers of the first and second tappet screws 53A and 53B and intersecting the axis C of the exhaust-side rocker shaft 51 at the right angles are disposed inside the axially opposite ends of the swinging support section 57. Therefore, the exhaust-side rocker shaft 52 is supported on the exhaust-side rocker shaft 52 over the length longer than the distance between the tappet screws 53A and 53B, and the exhaust-side rocker arms 50A is supported more stably.

The roller shaft 63 is fitted and fixed in the exhaust-side rocker arm 50A, and the roller 56 in rolling contact with the valve operating cam 55 is rotatably carried on the roller shaft 63. However, the roller shaft 63 is shorter than the distance between the first and second support walls 58 and 59 provided to extend from the opposite ends of the swinging support section 57, and is fitted and fixed at the inner ends of the pair of shaft insertion bores 66, 66 which are coaxially provided in the exhaust-side rocker arm 50A with their portions axially outer than opposite ends of the roller shaft 63 being left as the hollow wall-removed portions 67, 67.

Thus, the portions of the shaft insertion bores 66 which are axially outer than the opposite ends of the roller shaft 63 are left in the hollow forms and hence, the weight of the entire exhaust-side rocker arm 50A can be reduced, and it is also possible to confirm, from the opposite sides of the exhaust-side rocker arm 50A, the state of the roller shaft 63 fixed to the rocker arm 50. Moreover, the roller shaft 63 can be formed at a relatively small length, whereby the assembling of the roller shaft 63 to the exhaust-side rocker arm 50A is facilitated. In addition, the roller shaft 63 can be formed so that it is difficult to deform, thereby ensuring a proper swinging movement of the exhaust-side rocker arm 50A. Loads from the exhaust valves VE, VE are applied to the first and second support walls 58 and 59, but the roller 56 can be supported by the roller shaft 63 disposed at the location kept away from the load-applied portions and hence, the rigidity of supporting of the roller 56 can be enhanced.

The shaft insertion bore 66 comprises the first insertion bore portion 66 adjacent to the opening 62 with the roller 56 accommodated therein, and the second insertion bore portion 66*b* connected at its inner end to the outer end of the first insertion bore portion 66 to form the step 66*c* facing on the side opposite from the opening 62 between the first and second insertion bore portions 66*a* and 66*b*. The opposite ends of the roller shaft 63 fitted in the first insertion bore portions 66*a*, 66*a* of the shaft insertion bores 66, 66 are in caulked engagement with the steps 66*c*, respectively, whereby the roller shaft 63 is fitted and fixed in the shaft insertion bores 66, 66. Therefore, the portions of the shaft insertion bores 66, 66 left in the hollow forms, i.e., the wall-removed portions 67, 67 can be formed at large areas as the second insertion bore portions 66*b*, 66*b*, and the weight of the entire exhaust-side rocker arm 50A can be further reduced. Further, since the roller shaft 63 is fixed in the caulked manner to the exhaust-side rocker arm 50A, the assembling of the roller shaft 63 to the exhaust-side rocker arm 50A is further facilitated.

Further, the pair of cylindrical shaft support portions 65, 65 defining the shaft insertion bores 66, 66 respectively are provided on the exhaust-side rocker arm 50A over the first and second support walls 58 and 59 and the opening 62, and the pair of cylindrical shaft support portions 65, 65 interconnected through the roller shaft 63 are connected to the support walls 58 and 59. Therefore, the rigidity of the support walls 58 and 59 and the rigidity of supporting of the roller 56 can be further enhanced.

The cylindrical swinging support section 57 provided at the base end of the exhaust-side rocker arm 50A so that it is swingably supported by the exhaust-side rocker shaft 51, comprises the thinner cylindrical portion 57*a* surrounding the exhaust-side rocker shaft 51, and the thicker cylindrical portions 57*b*, 57*b* thicker than the thinner cylindrical portion 57*a* surrounding the exhaust-side rocker shaft 51 and integrally connected to the axially opposite ends of the thinner cylindrical portion 57*a*, respectively. Therefore, the central portion of the swinging support section 57 can be formed at a smaller thickness to avoid an increase in weight of the exhaust-side rocker arm 50A, while the opposite ends of the swinging support section 57 having a possibility that a large load may be applied, can be formed at a larger thickness to enhance the rigidity of supporting of the exhaust-side rocker arm 50A and the durability of the latter.

In addition, the grooves 68, 68 capable of accumulation of an oil between the grooves and the outer surface of the exhaust-side rocker shaft 51 are provided in the inner surfaces of the opposite ends of the swinging support section 57 along the axis of the exhaust-side rocker shaft 51, i.e., in the inner surfaces of the thicker cylindrical portions 57*b*, 57*b*, respectively. Therefore, the oil can be accumulated between the opposite ends of the swinging support section 57 and the exhaust-side rocker shaft 51, and even if the exhaust-side rocker arm 50A is inclined, an uneven wear can be prevented to the utmost from being produced, leading to an enhanced durability. Moreover, the grooves 68, 68 are merely provided in the inner surface of the swinging support section 57 at its opposite ends and hence, the weight of the exhaust-side rocker arm 50A cannot be increased, and a reduction in rigidity of the swinging support section 57 can be inhibited.

Furthermore, the first and second support walls 58 and 59, at the tip ends of which the first and second tappet screws 53A and 53B are mounted to abut against the upper end of the exhaust valves VE, VE, are provided to extend from the opposite ends of the swinging support section 57 at the locations corresponding to the grooves 68, 68. Therefore, a slight reduction in rigidity of the opposite ends of the swinging support section 57 due to the provision of the grooves 68, 68 can be made up for by the first and second support walls 58 and 59.

The outer periphery of the exhaust-side rocker arm 50A is formed by the swinging support section 57, the first support wall 58, the second support wall 59 and the connection wall 60, and the recesses 69 and 70 are defined at least in the upper surface of the exhaust-side rocker arm 50A by the portions surrounded by the swinging support section 57, the first support wall 58, the second support wall 59 and the connection wall 60. Therefore, it is possible to provide a reduction in weight of the exhaust-side rocker arm 50A, while avoiding a reduction in rigidity of the exhaust-side rocker arm 50A.

Moreover, one of the recesses 69 is disposed between the pair of shaft support portions 65, 65 and the swinging support section 57, and the oil can be supplied to the roller 56 accommodated in the opening 62. Therefore, the oil scattered within the valve operating chamber can be reliably accumulated at a portion of the exhaust-side rocker arm 50A which is swung in a relatively small amount, thereby lubricating the roller 56, and hence, it is unnecessary to provide a passage for supplying the oil to the roller 56 in the exhaust-side rocker arm 50A, thereby reducing the number of steps of processing the exhaust-side rocker arm 50A.

The other recess 70 is defined in the exhaust-side rocker arm 50A between the shaft support portions 65, 65 and the connection wall 60 to enable the supplying of the oil to the roller 56 and hence, the weight of the tip end of the exhaust-side rocker arm 50A can be reduced to alleviate the inertial weight, while performing the lubrication of the roller 56.

The axially central portion of the swinging support section 57 in the exhaust-side rocker arm 50A is disposed at the location corresponding to the plug insertion tube 36 mounted in the cylinder head 16, and the notches 71 and 72 connected smoothly to each other and formed into the arcuate shape recessed on the side adjacent to the plug insertion tube 36 are provided in the swinging support section 57 and the exhaust-side rocker shaft 51 at the location corresponding to the plug insertion tube 36. Therefore, it is possible not only to reduce the weight of the exhaust-side rocker arm 50A, but also the exhaust-side rocker shaft 51 and the plug insertion tube 36 can be disposed in the proximity to each other in such a manner that a portion of the plug insertion tube 36 is accommodated in the notch 71, and the limitation of the layout of the exhaust-side rocker arm 50A within the valve operating chamber can be moderated to contribute to the compactness of the entire engine.

Moreover, the notches 71 and 72 are provided in the swinging support section 57 and the exhaust-side rocker shaft 51 between the connections of the first and second support walls 58 and 59 to the swinging support section 57 and hence, the notches 71 and 72 can be disposed at the portions to which a relatively small stress is applied during driving of the exhaust valves VE, VE, thereby reducing the influence to the rigidity due to the provision of the notch 71 in the exhaust-side rocker arm 50A to reduce the weight of the exhaust-side rocker arm 50A.

The oil is supplied from the oil supply passage 74 in the exhaust-side rocker shaft 51 through the oil supply bore 75 and the oil injection bore 73 to the roller 56, and the oil injection bore 73 is provided in the swinging support section 57 on the side opposite to the notch 71, with respect to the axis C of the exhaust-side rocker shaft 51, which notch is provided in the swinging support section 57 in such a manner that an outer surface of a portion of the exhaust-side rocker shaft 71 provided with the notch 72 faces the notch 71. Therefore, it is possible to conduct a boring for the oil injection bore 73 from the side of the notch 71, thereby facilitating the boring for the oil injection bore 73.

The first and second boss portions 58*a* and 59*a*, in which the first and second tappet screws 53A and 53B are threadedly f fitted to abut against the upper ends of the exhaust valves VE, VE, are disposed at the tip ends of the exhaust-side rocker arm 50A and arranged in the direction along the axis C of the exhaust-side rocker shaft 51, but they are interconnected by the connection wall 60. Therefore, the rigidity of the tip end of the exhaust-side rocker arm 50A driving the pair of exhaust valves VE, VE can be enhanced sufficiently and moreover, the connection wall 60 comprises the first and second wall portions 60*a* and 60*b* intersecting each other at the right angles in the plane perpendicular to the axis C of the exhaust-side rocker shaft 51, i.e., the swinging axis of the exhaust-side rocker arm 50A. Therefore, it is possible to suppress the increase in weight of the exhaust-side rocker arm 50A due to the connection wall 60 to the minimum, while maintaining the sufficient connection rigidity. In addition, the second wall portion 60*b* of the connection wall 60 is formed to extend in parallel to the axis of the exhaust-side rocker shaft 51, so that its outer surface is connected flush to the outer surfaces of the tip ends of the first and second boss portions 58*a* and 59*a*. Therefore, it is possible to eliminate the concentration of a stress on the connections between the connection wall 60 and the boss portions 58*a* and 59*a*, thereby enhancing the durability of the exhaust-side rocker arm 50A, while sufficiently enhancing the rigidity of the tip end of the exhaust-side rocker arm 50A.

Further, one side of the opening 62 provided in the exhaust-side-rocker arm 50A to accommodate the roller 56 is formed by the inner surface of the first wall portion 60*a* of the connection wall 60, and the connection wall 60 can be disposed in proximity to the roller 56, thereby enhancing the rigidity of supporting of the roller 56.

Figure 8:
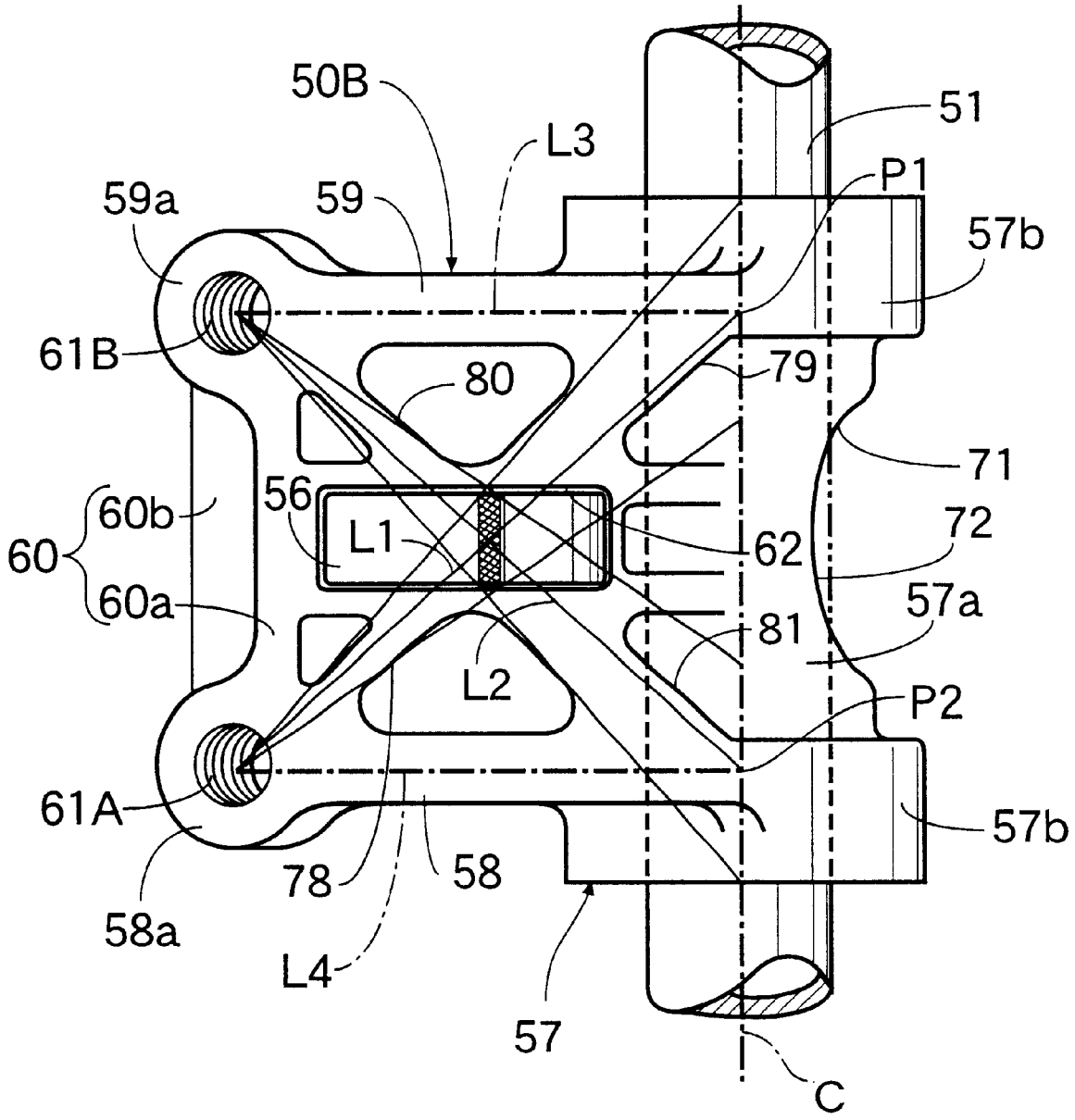
FIG. 8 is a plan view similar to FIG. 3, but showing an exhaust-side rocker arm in a second embodiment of the present invention.
Figure 9:
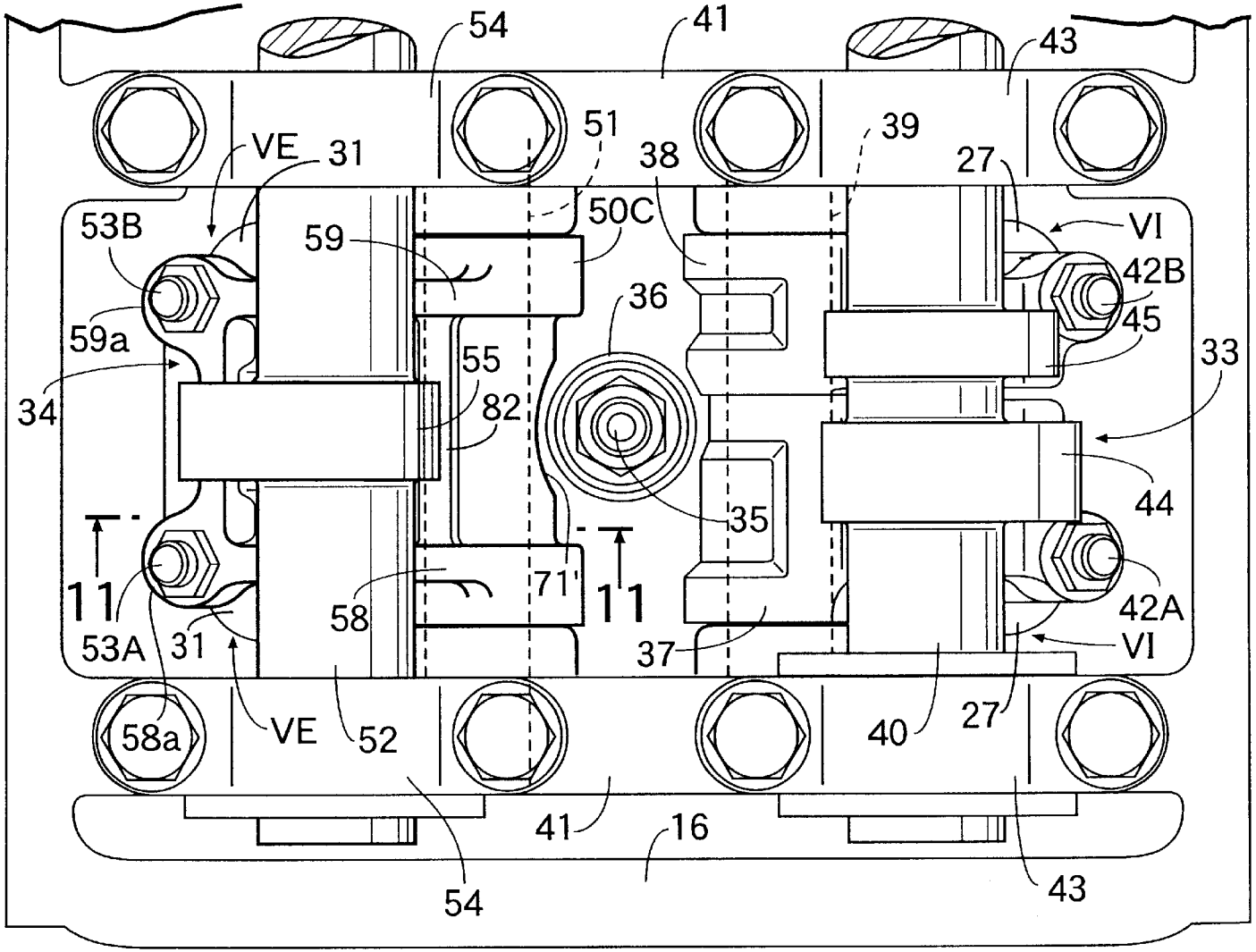

FIG. 8 shows a second embodiment of the present invention, wherein portions or components corresponding to those in the first embodiment are designated by like reference characters.

Reinforcing ribs 78 and 79 are provided on an exhaust-side rocker arm 50B with the roller 56 sandwiched therebetween to extend along the first straight line L1 passing the center of the first tappet screw 53A, i.e., the center of the threaded bore 61A in the first boss portion 58*a* and the center of the roller 56. Reinforcing ribs 80 and 81 are also provided on the exhaust-side rocker arm 50B with the roller 56 sandwiched therebetween to extend along the second straight line L2 passing the center of the second tappet screw 53B, i.e., the center of the threaded bore 61B in the second boss portion 59*a* and the center the roller 56.

According to the second embodiment, it is possible to further enhance the rigidity of the exhaust-side rocker arm 50B, and it is also possible to prevent uneven wear from being produced in the swinging support portion 57 and the roller 56. This can contribute to an enhancement in durability of a bearing (the needle bearing in the first embodiment) interposed between the roller 56 and the roller shaft 63 (see the first embodiment).

FIGS. 9 to 12 show a third embodiment of the present invention, wherein portions or components corresponding to those in each of the previous embodiments are designated by like reference characters.

An axially central portion of a swinging support section 57 of an exhaust-side rocker arm 50C, i.e., an axially intermediate portion of a thinner cylindrical portion 57*a* is disposed at a location corresponding to the plug insertion tube 36, and an arcuate notch 71' recessed on a side opposite to the plug insertion tube 36 is provided in the thinner cylindrical portion 57*a* of the swinging support section 57 at the location corresponding to the plug insertion tube 36. A portion of the plug insertion tube 36 is accommodated in the notch 71'.

Moreover, a pair of ribs 82, 82 are projectingly provided on the thinner cylindrical portion 57*a* of the swinging support section 57 to extend in a direction intersecting a plane perpendicular to the axis C of the exhaust-side rocker shaft 51, e.g., in a direction intersecting such plane at right angles in the third embodiment, i.e., in parallel to the axis C of the exhaust-side rocker shaft 51. The ribs 82, 82 interconnect the thicker cylindrical portions 57*b*, 57*b* at a location kept away from the notch 71', and are provided on the outer surface of the thinner cylindrical portion 57*a* at locations symmetrical with respect to the axis of the exhaust-side rocker shaft 51, particularly, so that they are connected at right angles to those ends of the first and second support walls 58 and 59 operatively connected to the exhaust valves VE, VE, which are adjacent to the thicker cylindrical portions 57*b*, 57*b*.

Figure 12:
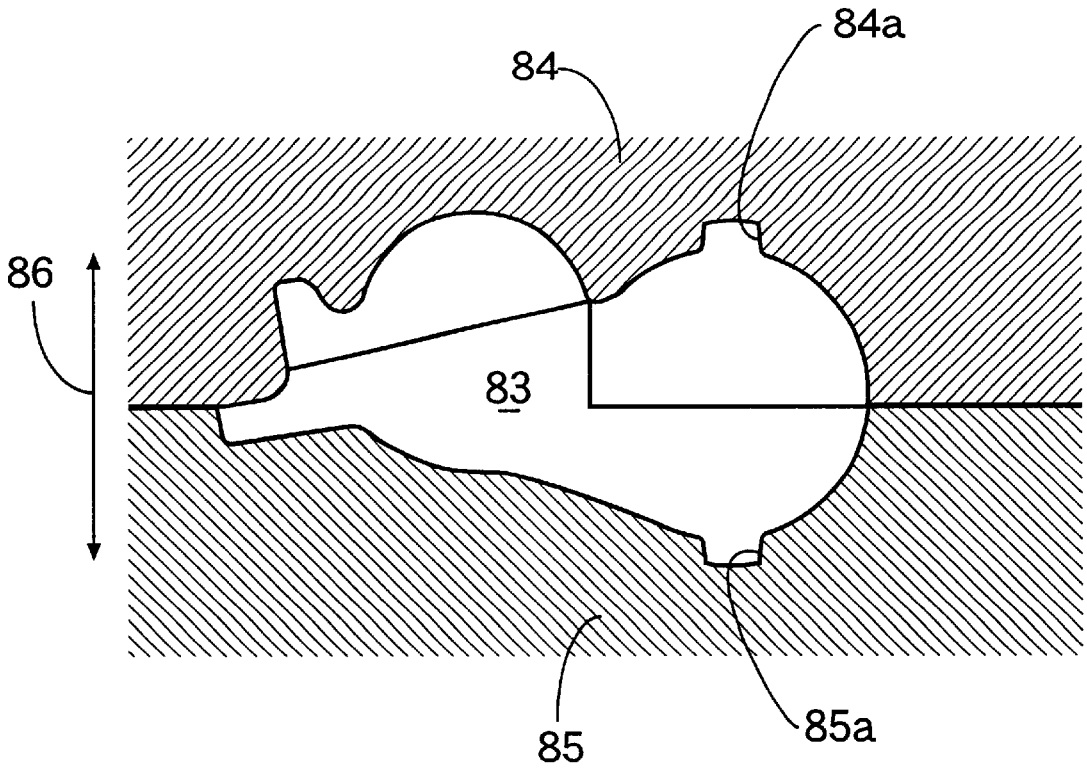

Referring carefully to FIG. 12, the exhaust-side rocker arm 50C is made by a casting process, for example, from an aluminum alloy, using a casting apparatus including dies 84 and 85 which defines a cavity 83 corresponding to a contour of the exhaust-side rocker arm 50C by cooperation with each other. Recesses 84*a* and 85*a* corresponding to the ribs 82, 82 are provided in the dies 84 and 85 to define portions of the cavity 83, and they are depressed in a direction extending in a direction 86 of parting of the dies 84 and 85. Namely, the ribs 82, 82 are formed to protrude from the swinging support section 57 in the direction extending in the direction 86 of parting of the dies 84 and 85.

Moreover, the direction 86 of parting of the dies 84 and 85 is set as a direction intersecting the plane perpendicular to a direction of a load applied to the exhaust-side rocker arm 50C from the valve operating cam 55 of the exhaust-side cam shaft 52 disposed above the exhaust-side rocker arm 50C (as a direction perpendicular to the plane in the present embodiment). The ribs 82, 82 are formed to protrude from the swinging support section 57 in the direction intersecting the plane perpendicular to the direction of the load applied to the exhaust-side rocker arm 50C from the valve operating cam 55.

The protrusion height of the ribs 82, 82 is set at such a level that the ribs 82, 82 do not protrude from the thicker cylindrical portions 57*b*, 57*b* at the opposite ends of the swinging support portion 57. Thus, an increase in size of the exhaust-side rocker arm 50C due to the provision of the ribs 82, 82 is inhibited.

In the third embodiment, the ribs 82, 82 are projectingly provided on the outer surface of the cylindrical swinging support section 57 provided at the base end of the exhaust-side rocker arm 50C to extend in the direction intersecting the plane perpendicular to the axis of the exhaust-side rocker shaft 51. Therefore, it is possible to avoid, to the utmost, the limitation of the layout of the exhaust-side rocker arm 50C, and to enhance the rigidity of the swinging support section 57, while suppressing an increase in weight of the exhaust-side rocker arm 50C to the minimum, as compared with a system in which the rigidity of the swinging support section is enhanced by increasing the thickness of the entire swinging support section 57. Moreover, the ribs 82, 82 are formed on the swinging support section 57 to extend in parallel to the axis C of the exhaust-side rocker shaft 51 in the present embodiment and therefore, it is possible to provide an increase in rigidity of the exhaust-side rocker arm 50C, while avoiding an increase in weight of the exhaust-side rocker arm 50C.

In addition, the ribs 82, 82 are provided on the outer surface of the thinner cylindrical portion 57*a* to connect the thicker cylindrical portions 57*b*, 57*b* of the swinging support portion 57 to each other. Therefore, the axially central portion of the swinging support section 57 can be formed at a smaller thickness, thereby avoiding an increase in weight of the exhaust-side rocker arm 50C, while the opposite end portions of the swinging support section 57, to which a large load may be applied, can be formed at a larger thickness, and the thicker cylindrical portions 57*b*, 57*b* can be interconnected by the ribs 82, 82, thereby further enhancing the rigidity of the swinging support section 57 to provide an increase in durability.

Moreover, the pair of ribs 82, 82 are provided on the outer surface of the thinner cylindrical portion 57*a* at the locations symmetrical with respect to the axis C of the exhaust-side rocker shaft 51 and hence, the rigidity of the swinging support section 57 can be enhanced by the extremely small number of the ribs 82, 82, and the increase in weight of the swinging support section 57, i.e., of the exhaust-side-rocker arm 50C can be suppressed to the minimum. Particularly, the ribs 82, 82 are provided on the outer surface of the thinner cylindrical portion 57*a* on the plane which is perpendicular to the first and second support walls 58 and 59 operatively connected to the exhaust valves VE, VE and which passes through the axis C of the exhaust-side rocker shaft 51. Thus, the ribs 82, 82 can be disposed in the direction perpendicular to the direction of the load applied to the swinging support section 57 from the side of the exhaust valves VE, VE, thereby effectively increasing the rigidity of the swinging support section 57.

Figure 10:
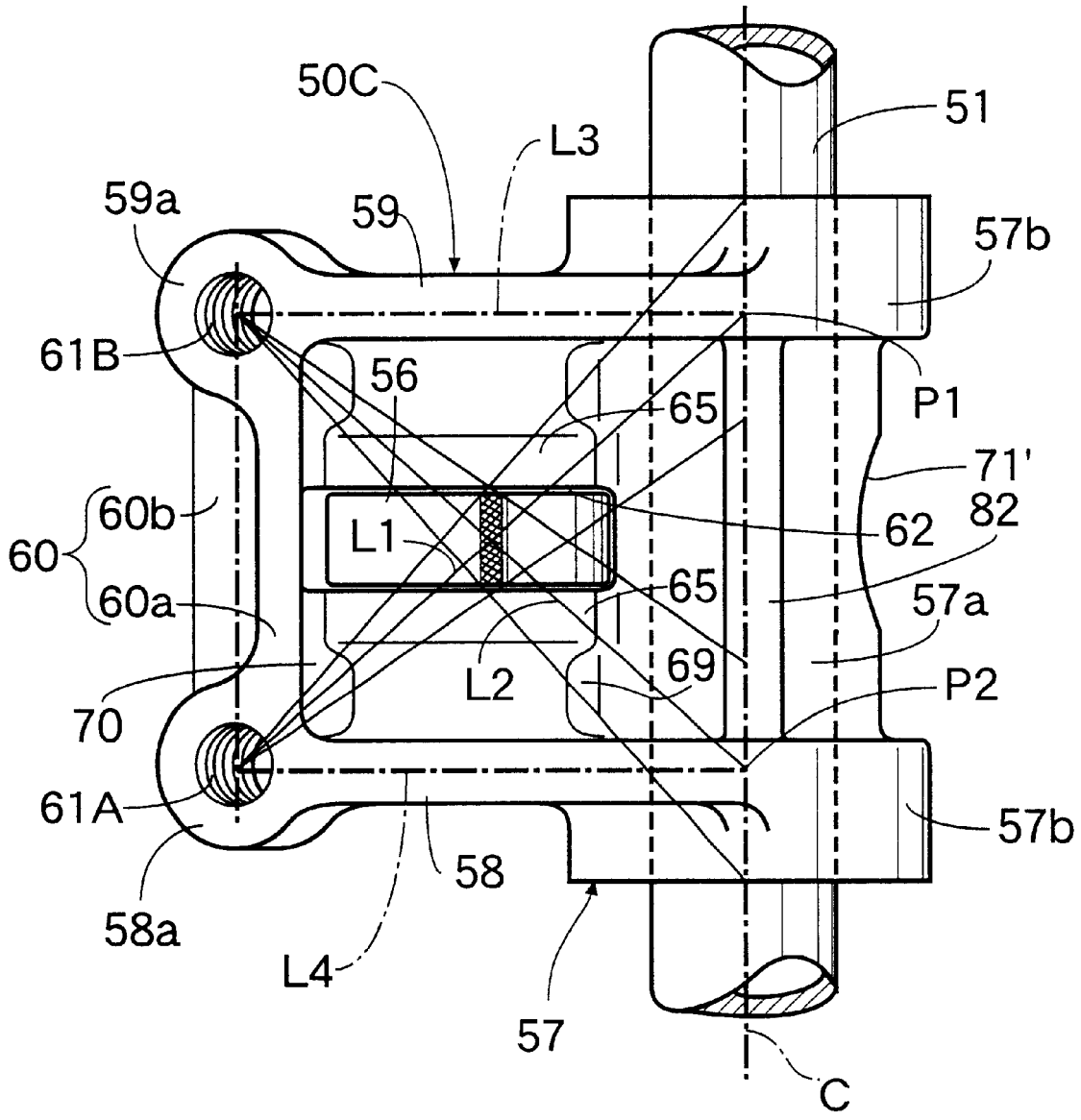
Figure 11:
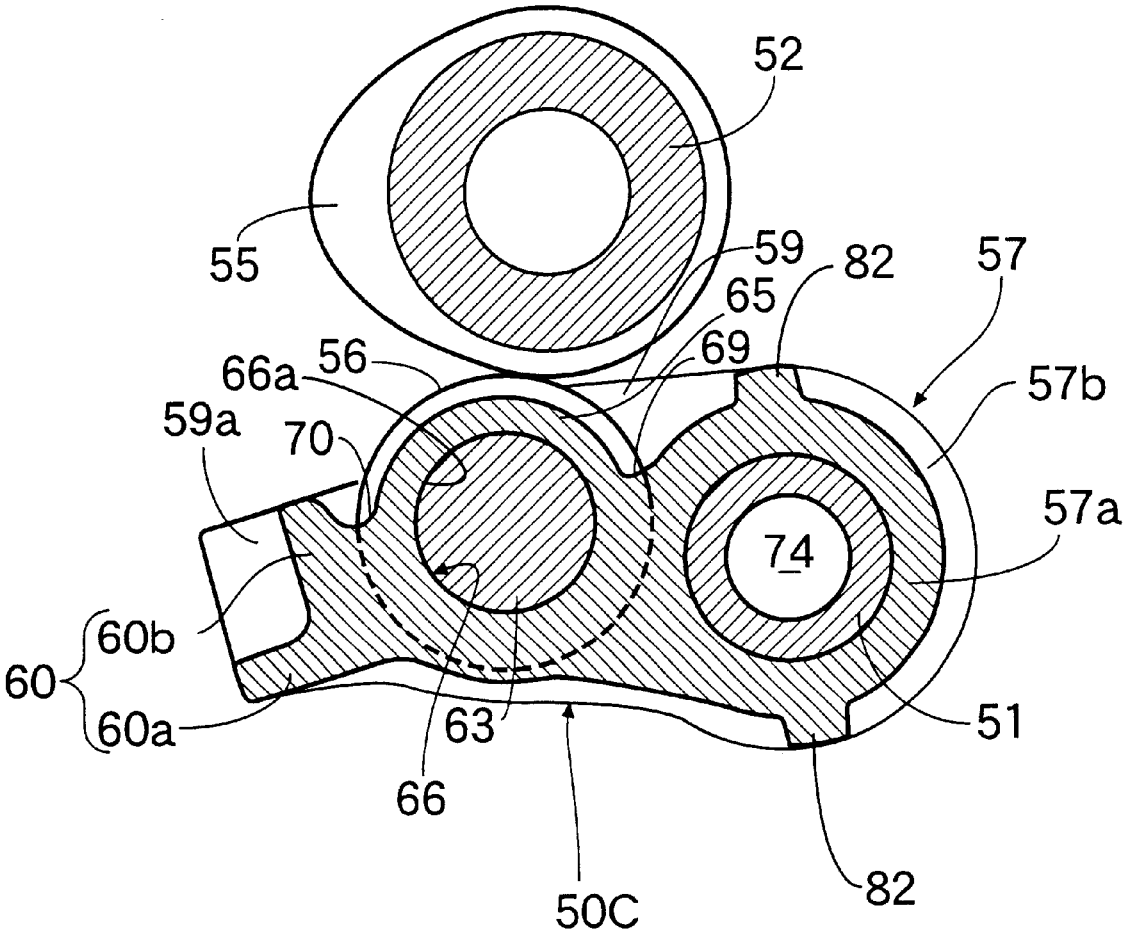

In addition, the ribs 82, 82 are provided on the outer surface of the thinner cylindrical portion 57*a* such that they are connected to those ends of the first and second support walls 58 and 59 operatively connected to the exhaust valves VE, VE, which are adjacent to the thicker cylindrical portions 57*b*, 57*b*, and hence, the rigidity of the exhaust-side rocker arm 50C can be increased more effectively. Moreover, as shown in FIG. 10, the first and second support walls 58 and 59, the connection wall 60 and the ribs 82 are connected to one another to form a right-angled quadrilateral shape and hence, the rigidity of the exhaust-side rocker arm 50C can be enhanced further.

The arcuate notch 71' recessed on the side opposite to the plug insertion tube 36 is provided in the thinner cylindrical portion 57*a* of the swinging support section 57 at the location corresponding to the plug insertion tube 36, and the ribs 82, 82 are provided on the thinner cylindrical portion 57*a* of the swinging support section 57 at the location kept away from the notch 71'. Therefore, the reduction in rigidity of the swinging support section 57 due to the provision of the notch 71' can be inhibited by the ribs 82, 82.

Moreover, the pair of ribs 82, 82 are formed to protrude from the upper and lower outer surfaces of the swinging support section 57 in the direction intersecting the plane perpendicular to the direction of application of the load to the exhaust-side rocker arm 50C from the valve operating cam 55 of the exhaust-side camshaft 52 and hence, the rigidity of the swinging support section 57 against a strike load from the valve operating cam 55 can be increased sufficiently. In addition, the rigidity of the swinging support section 57 against the strike load from the valve operating cam 55 can be further increased by the ribs 82, 82 formed to protrude from the upper and lower outer surfaces of the swinging support section 57 in the direction intersecting, at the tight angles, the plane perpendicular to the direction of application of the load from the valve operating cam 55 to the exhaust-side rocker arm 50C.

Further, since the pair of ribs 82, 82 are formed to protrude from the swinging support section 57 in the direction of parting of the dies 84 and 85 in the formation of the exhaust-side rocker arm 50C by the casting process, the ribs 82, 82 for increasing the rigidity of the swinging support section 57 can be formed easily.

Although the embodiments of the present invention have been described in detail, it will be understood that the present invention is not limited to the above-described embodiments, and various modifications in design may be made without departing from the spirit and scope of the invention defined in claims.

For example, the present invention is applicable to a valve operating system for an intake valve. The present invention is also applicable to a valve operating system in which a cam slipper is provided on a rocker arm 50A, 50B, 50C to come into contact with the valve operating cam 55, in place of the roller 56 which is in rolling contact with the valve operating cam 55. The ribs 82, 82 have been described as being formed to extend in parallel to the axis C of the exhaust-side rocker shaft 51 in the above-described embodiments, but the ribs may be formed to extend in a direction intersecting the axis C, or the plurality of ribs may be formed to intersect one another.

What is claimed is:

1. A valve operating system in an internal combustion engine including a cylindrical swinging support section provided at a base end of a rocker arm and swingably carried on a rocker shaft mounted in a cylinder head, a plurality of valve abutments provided at a tip end of said rocker arm and capable of being individually put into abutment against upper ends of a plurality of engine valves, and a cam abutment provided on said rocker arm in an intermediate portion between said swinging support section and each of said valve abutments to come into contact with a valve operating cam, wherein said swinging support section includes a thinner cylindrical portion surrounding said rocker shaft, and thicker cylindrical portions which are each formed of a thickness larger than that of said thinner cylindrical portion into a cylindrical shape to surround said rocker shaft and which are integrally and continuously provided at axially opposite ends of said thinner cylindrical portion, respectively, said thicker cylindrical portions having grooves provided in their inner surfaces respectively and capable of accumulating an oil between said inner surfaces and an outer surface of said rocker shaft.

2. A valve operating system in an internal combustion engine, including a cylindrical swinging support section provided at a base end of a rocker arm and swingably carried on a rocker shaft mounted in a cylinder head, a plurality of valve abutments provided at a tip end of said rocker arm and capable of being individually put into abutment against upper ends of a plurality of engine valves, and a cam abutment provided on said rocker arm in an intermediate portion between said swinging support section and each of said valve abutments to come into contact with a valve operating cam, wherein said swinging support section includes a thinner cylindrical portion surrounding said rocker shaft, and thicker cylindrical portions which are formed at a thickness larger than that of said thinner cylindrical portion into a cylindrical shape to surround said rocker shaft and which are integrally and continuously provided at axially opposite ends of said thinner cylindrical portion, respectively, wherein said swinging support section is formed at a length larger than a distance between first and second ones of said valve abutments, and straight lines passing through centers of said first and second valve abutments and perpendicular to the axis of said rocker shaft are disposed at locations of the rocker shaft inner than the axially opposite ends of said swinging support section.

3. A valve operating system in an internal combustion engine, comprising a cylindrical swinging support section provided at a base end of a rocker arm and swingably carried on a rocker shaft mounted in a cylinder head, a plurality of valve abutments provided at a tip end of said rocker arm and capable of being individually put into abutment against upper ends of a plurality of engine valves, and a cam abutment provided on said rocker arm in an intermediate portion between said swinging support section and each of said valve abutments to come into contact with a valve operating cam, wherein said swinging support section has grooves provided in its inner surface at opposite ends thereof along the axis of said rocker shaft and capable of accumulating an oil between said opposite ends and an outer surface of said rocker shaft.

4. A valve operating system in an internal combustion engine, including a cylindrical swinging support section provided at a base end of a rocker arm and swingably carried on a rocker shaft mounted in a cylinder head, a plurality of valve abutments provided at a tip end of said rocker arm and capable of being individually put into abutment against upper ends of a plurality of engine valves, and a cam abutment provided on said rocker arm in an intermediate portion between said swinging support section and each of said valve abutments to come into contact with a valve operating cam, wherein said swinging support section includes a thinner cylindrical portion surrounding said rocker shaft, and thicker cylindrical portions which are formed at a thickness larger than that of said thinner cylindrical portion into a cylindrical shape to surround said rocker shaft and which are integrally and continuously provided at axially opposite ends of said thinner cylindrical portion, respectively, wherein a pair of intersection points, at which the following straight lines and the axis of said rocker shaft intersect one another, are disposed at locations inner than the axially opposite ends of said swinging support section:

a first straight line passing through (1) a center of a first one of said valve abutments arranged in parallel to the axis of said rocker shaft, which is disposed at one end along the axis of said rocker shaft and (2) an area of contact of said valve operating cam with said cam abutment; and a second straight line passing through (1) a center of a second one of said valve abutments, which is disposed at the other end along the axis of said rocker shaft and (2) the area of contact of said valve operating cam with said cam abutment, wherein said swinging support section is formed at a length larger than a distance between first and second ones of said valve abutments, and straight lines passing through centers of said first and second valve abutments and perpendicular to the axis of said rocker shaft are disposed at locations of the rocker shaft inner than the axially opposite ends of said swinging support section.

5. A valve operating system in an internal combustion engine, comprising a cylindrical swinging support section provided at a base end of a rocker arm and swingably carried on a rocker shaft mounted in a cylinder head, a plurality of valve abutments provided at a tip end of said rocker arm and capable of being individually put into abutment against upper ends of a plurality of engine valves, and a cam abutment provided on said rocker arm in an intermediate portion between said swinging support section and each of said valve abutments to come into contact with a valve operating cam, wherein said swinging support section has grooves provided in its inner surface at opposite ends thereof along the axis of said rocker shaft and capable of accumulating an oil between said opposite ends and an outer surface of said rocker shaft, wherein each said groove is provided on a straight line that extends perpendicular to the axis of said rocker shaft and passes through the center of one of said engine valves which is located on the same axial side as of the groove along the axis of the rocker shaft.

6. A valve operating system in an internal combustion engine, comprising a cylindrical swinging support section provided at a base end of a rocker arm and swingably carried on a rocker shaft mounted in a cylinder head, a plurality of valve abutments provided at a tip end of said rocker arm and capable of being individually put into abutment against upper ends of a plurality of engine valves, and a cam abutment provided on said rocker arm in an intermediate portion between said swinging support section and each of said valve abutments to come into contact with a valve operating cam, wherein said swinging support section has a groove provided in its inner surface at least at one of opposite ends thereof along the axis of said rocker shaft and capable of accumulating an oil between said one of opposite ends and an outer surface of said rocker shaft, wherein said groove is provided on a straight line that extends perpendicular to the axis of said rocker shaft and passes through the center of one of said engine valves which is located on the same axial side as of the groove along the axis of said rocker shaft.

7. A valve operating system in an internal combustion engine, including a cylindrical swinging support section provided at a base end of a rocker arm and swingably carried on a rocker shaft mounted in a cylinder head, a plurality of valve abutments provided at a tip end of said rocker arm and capable of being individually put into abutment against upper ends of a plurality of engine valves, and a cam abutment provided on said rocker arm in an intermediate portion between said swinging support section and each of said valve abutments to come into contact with a valve operating cam, wherein said swinging support section includes a thinner cylindrical portion surrounding said rocker shaft, and thicker cylindrical portions which are each formed of a thickness larger than that of said thinner cylindrical portion into a cylindrical shape to surround said rocker shaft and which are integrally and continuously provided at axially opposite ends of said thinner cylindrical portion, respectively, wherein a pair of first and second intersection points, at which the following straight lines and the axis of said rocker shaft intersect one another, are disposed at locations inner than the axially opposite ends of said swinging support section: a first straight line passing through (1) a center of a first one of said valve abutments arranged in parallel to the axis of said rocker shaft, which is disposed at one end along the axis of said rocker shaft, and (2) an area of contact of said valve operating cam with said cam abutment; and a second straight line passing through (1) a center of a second one of said valve abutments, which is disposed at the other end along the axis of said rocker shaft and (2) the area of contact of said valve operating cam with said cam abutment;

wherein the following one intersection point and said second intersection point are located in one of said thicker wall portions:

a third intersection point at which a straight line passing through the center of said first valve abutment intersects the axis of said rocker shaft perpendicularly to the latter; and wherein the following fourth intersection point and said first intersection point are located in another of said thicker wall portions:

a fourth intersection point at which a straight line passing through the center of said second valve abutment intersects the axis of said rocker shaft perpendicularly to the latter.

8. A valve operating system in an internal combustion engine, including a cylindrical swinging support section provided at a base end of a rocker arm and swingably carried on a rocker shaft mounted in a cylinder head, a plurality of valve abutments provided at a tip end of said rocker arm and capable of being individually put into abutment against upper ends of a plurality of engine valves, and a cam abutment provided on said rocker arm in an intermediate portion between said swinging support section and each of said valve abutments to come into contact with a valve operating cam, wherein said swinging support section includes a thinner cylindrical portion surrounding said rocker shaft, and thicker cylindrical portions which are each formed of a thickness larger than that of said thinner cylindrical portion into a cylindrical shape to surround said rocker shaft and which are integrally and continuously provided at axially opposite ends of said thinner cylindrical portion, respectively, wherein a pair of first and second intersection points, at which the following straight lines and the axis of said rocker shaft intersect one another, are disposed at locations inner than the axially opposite ends of said swinging support section: a first straight line passing through (1) a center of a first one of said valve abutments arranged in parallel to the axis of said rocker shaft, which is disposed at one end along the axis of said rocker shaft, and (2) an area of contact of said valve operating cam with said cam abutment; and a second straight line passing through (1) a center of a second one of said valve abutments, which is disposed at the other end along the axis of said rocker shaft and (2) the area of contact of said valve operating cam with said cam abutment;

wherein the following one intersection point is located in one of said thicker wall portions:

a third intersection point at which a straight line passing through the center of one of said first and second valve abutments intersects the axis of said rocker shaft perpendicularly to the latter; and one of said first and second intersection points that passes through the center of the other of said first and second valve abutments is also located in said one of the thicker wall portions.

9. A valve operating system in an internal combustion engine according to claim 5, 6, 7, or 8, wherein a first one of said valve abutments arranged in parallel to the axis of said rocker shaft, which is disposed on one side along the axis of said rocker shaft, is provided at a tip end of a first support wall provided to extend from one end of said swinging support section at a location corresponding to one of said grooves, and a second one of said valve abutments, which is disposed on the other side along the axis of said rocker shaft, is provided at a tip end of a second support wall provided to extend from the other end of said swinging support section at a location corresponding to the other groove.

10. A valve operating system in an internal combustion engine according to claim 1, 2, 4, 5, 6, 7 or 8, wherein said swinging support section has a rib projectingly provided on an outer surface thereof to extend in a direction intersecting a plane perpendicular to the axis of said rocker shaft.

11. A valve operating system in an internal combustion engine according to claim 10, wherein said rib is provided on an outer surface of said thinner cylindrical portion to connect said thicker cylindrical portions to each other.

12. A valve operating system in an internal combustion engine according to claim 10, wherein said rib is formed to protrude from said swinging support section in a direction intersecting a plane perpendicular to a direction of application of a load from said valve operating cam to said rocker arm.

13. A valve operating system in an internal combustion engine according to claim 10, wherein a pair of said ribs are provided on the outer surface of said swinging support section at locations symmetric with respect to the axis of said rocker shaft.

14. A valve operating system in an internal combustion engine according to claim 7, wherein said cylinder head having said rocker shaft mounted therein has a mounting member mounted therein and disposed sideways of said swinging support section, and said swinging support section has a notch provided therein at a location corresponding to said mounting member and recessed on a side adjacent to said mounting member.

15. A valve operating system in an internal combustion engine according to claim 11, wherein said rib is formed to protrude from said swinging support section in a direction intersecting a plane perpendicular to a direction of application of a load from said valve operating cam to said rocker arm.

16. A valve operating system in an internal combustion engine according to claim 11, wherein a pair of said ribs are provided on the outer surface of said swinging support section at locations symmetric with respect to the axis of said rocker shaft.

17. A valve operating system in an internal combustion engine according to claim 11, wherein said cylinder head having said rocker shaft mounted therein has a mounting member mounted therein and disposed sideways of said swinging support section, and said swinging support section has a notch provided therein at a location corresponding to said mounting member and recessed on a side adjacent to said mounting member.

* * * * *